US008408224B2

(12) United States Patent
Ozuna et al.

(10) Patent No.: US 8,408,224 B2
(45) Date of Patent: Apr. 2, 2013

(54) WALKING ASSISTANCE DEVICE

(75) Inventors: Mario Ozuna, American Fork, UT (US); Adam Ozuna, American Fork, UT (US)

(73) Assignee: Mario Ozuna, American Fork, UT (US)

( * ) Notice: Subject to any disclaimer, the term of this patent is extended or adjusted under 35 U.S.C. 154(b) by 0 days.

(21) Appl. No.: 12/426,055

(22) Filed: Apr. 17, 2009

(65) Prior Publication Data

US 2010/0229903 A1 Sep. 16, 2010

Related U.S. Application Data

(60) Provisional application No. 61/159,079, filed on Mar. 10, 2009, provisional application No. 61/170,047, filed on Apr. 16, 2009.

(51) Int. Cl.
*A45B 1/00* (2006.01)
*A45B 9/04* (2006.01)

(52) U.S. Cl. ..... 135/84; 135/65; 135/82; 135/86

(58) Field of Classification Search ..... 135/77, 135/82, 84, 86
See application file for complete search history.

(56) References Cited

U.S. PATENT DOCUMENTS

| | | | | | |
|---|---|---|---|---|---|
| 4,274,430 | A | * | 6/1981 | Schaaf et al. | 135/65 |
| D324,946 | S | | 3/1992 | Karten | |
| 5,217,419 | A | | 6/1993 | Harwood | |
| 5,224,506 | A | | 7/1993 | Allen et al. | |
| 5,238,013 | A | | 8/1993 | Battiston et al. | |
| D349,144 | S | | 7/1994 | Greene | |
| 5,331,989 | A | | 7/1994 | Stephens | |
| 5,376,139 | A | | 12/1994 | Pitkin | |
| 5,409,029 | A | * | 4/1995 | Davis | 135/68 |
| 5,485,862 | A | * | 1/1996 | Kahn | 135/77 |
| 5,782,256 | A | * | 7/1998 | Bradley | 135/77 |
| D412,615 | S | | 8/1999 | Brightbill et al. | |
| 5,996,602 | A | | 12/1999 | Cato, III | |
| D419,288 | S | | 1/2000 | Hartfield | |
| D420,213 | S | | 2/2000 | Almond, Jr. | |
| D425,293 | S | | 5/2000 | Maalik | |
| D426,495 | S | | 6/2000 | Vaccaro | |
| 6,131,593 | A | | 10/2000 | Greene et al. | |
| D433,354 | S | | 11/2000 | Donets | |
| D442,123 | S | | 5/2001 | Johnston | |
| D481,531 | S | | 11/2003 | Haythornthwaite | |
| 6,702,859 | B1 | | 3/2004 | Laghi | |

(Continued)

OTHER PUBLICATIONS

U.S. Appl. No. 61/159,079, filed Mar. 10, 2009, Ozuna et al.
U.S. Appl. No. 61/170,047, filed Apr. 16, 2009, Ozuna et al.
U.S. Appl. No. 29/334,692, filed Mar. 31, 2009, Ozuna et al.
U.S. Appl. No. 29/334,702, filed Mar. 31, 2009, Ozuna et al.
U.S. Appl. No. 29/334,706, filed Mar. 31, 2009, Ozuna et al.
International Search Report and Written Opinion from PCT/US2010/026827, dated May 4, 2010.
Office Action dated Apr. 12, 2010 from U.S. Appl. No. 29/334,692.
U.S. Appl. No. 29/386,768 Office Action mailed Jun. 22, 2012.
U.S. Appl. No. 29/334,706 Notice of Allowance mailed Nov. 2, 2009.
U.S. Appl. No. 29/334,692 Notice of Allowance mailed Aug. 12, 2010.
U.S. Appl. No. 29/334,702 Notice of Allowance mailed Sep. 10, 2010.

*Primary Examiner* — David Dunn
*Assistant Examiner* — Danielle Jackson
(74) *Attorney, Agent, or Firm* — Kunzler Law Group, PC

(57) ABSTRACT

A walking assistance device is disclosed that includes a support member having a first end and a second end. Attached to the support member is a hand grip, and attached to the second end is a base member. The base member includes a rounded surface that is configured to rotatably pivot relative to a walking surface as a user walks. The base member may further include a foot portion that has a toe and a heel. The toe and the heel may be the same length, or alternatively they may have varying lengths. Additionally, a pad is optionally attached to the foot portion and may be configured with tread to engage the walking surface in a way that provides traction to the walking assistance device.

19 Claims, 7 Drawing Sheets

U.S. PATENT DOCUMENTS

| | | | |
|---|---|---|---|
| D511,889 | S | 11/2005 | Cockrell |
| D521,720 | S | 5/2006 | Karasin et al. |
| D531,399 | S | 11/2006 | Olerud |
| D576,402 | S | 9/2008 | White |
| 7,509,966 | B2 | 3/2009 | Karasin et al. |
| 7,610,926 | B2 | 11/2009 | Adams |
| 7,637,274 | B1 | 12/2009 | Dodson |
| D610,792 | S | 3/2010 | Ozuna et al. |
| D628,791 | S | 12/2010 | Ozuna et al. |
| D628,792 | S | 12/2010 | Ozuna et al. |
| 2005/0016572 | A1 | 1/2005 | Townsend et al. |
| 2009/0255562 | A1* | 10/2009 | Ruddy ..... 135/77 |

* cited by examiner

WALKING ASSISTANCE DEVICE

CROSS-REFERENCE TO RELATED APPLICATIONS

This application claims the benefit of, and priority to, U.S. Provisional Patent Application Ser. No. 61/159,079, filed on Mar. 10, 2009 and entitled "Sure Step," which is incorporated in its entirety herein by this reference. In addition, this application claims the benefit of, and priority to, U.S. Provisional Patent Application Ser. No. 61/170,047, filed on Apr. 16, 2009 and entitled "Walking Assistance Device." This application also claims benefit of, and priority to, the following U.S. Design Patent applications: Ser. No. 29/334,706 entitled "Walk-Rite Base Assembly," Ser. No. 29/334,692 entitled "Sure Step Extension Pad," and Ser. No. 29/334,702 entitled "Outrigger," all of which were filed on Mar. 31, 2009. The above referenced United States Design Patents are also incorporated in their entirety herein by this reference.

BACKGROUND

1. The Field of the Invention

In general, the present invention is directed to an apparatus for supportively assisting a user to maintain balance and stability. In particular, examples of the present invention are directed toward walking assistance devices, such as walking sticks, canes, and/or crutches, which provide for stability and facilitate comfortable and reliable use.

2. Background and Related Art

Conventional walking assistance devices are generally thought of as a medical device that may support all or part of a user's body weight due to an associated injury or medical condition. Alternatively, walking assistance devices may be used in recreation to provide stability, for example when mountain hiking. In order to improve the mobility of users, various shapes and sizes of walking assistance devices have been used as supportive aids. Traditionally, walking assistance devices are made of metal, and are configured to extend from the user's underarm (in the case of a crutch) to the walking surface, or extend from the user's hand (in the case of a walking stick or cane) to the walking surface. Walking assistance devices may be used for just a few days, or alternatively, they may be used a lifetime depending on the needs of the user.

As walking assistance devices have evolved, the conventional walking assistance device configurations have often lacked mindful designing and engineering, thus preventing a user from using these walking assistance devices in a way that facilitates a comfortable body motion. The inability of many conventional walking assistance devices to provide a natural and comfortable supporting aid may lead to additional health problems and/or conditions due to the use of the walking assistance device. For example, carpal tunnel syndrome and neuropathy are two medical conditions that a user may incur as a result of using a walking assistance device that does not facilitate comfortable body movement. Moreover, conventional walking assistance devices may cause injury to a user due to the instability or lack of appropriate traction on the walking surface by the walking assistance device.

Accordingly, one possible way in which conventional walking assistance devices may prevent natural movement, and/or cause instability that leads to user injury, deals with how the end or base of the walking assistance device contacts the walking surface. For example, conventional walking assistance devices may include a flat, rigid base that contacts the walking surface. Such an example base may produce angulations as the user is using the walking assistance device that forces unnatural and aggravating body movement if the user wishes to keep a large surface area of the flat base in contact with the ground, which may lead to health problems. Moreover, if the user does not try to keep all of the flat base in contact with the ground, it may produce a situation where only a small portion of the base interfaces with the walking surface so that the base does not properly grip the walking surface. In this situation, the base may slip on the walking surface and could result in the user being injured in a fall or aggravating a condition while trying to catch his/her balance.

Past attempts to improve the conventional walking assistance device base leave much to be desired. While some designs attempt to address these long held aspects of conventional walking assistance devices, they do so with a significant decrease in the stability of the walking device, and in particular, to the ability of the walking device to grip the walking surface. Other attempts have offered bulky and complicated base assemblies which are prone to failure and/or are expensive.

Accordingly, what is needed is a walking assistance device that permits natural comfortable use and provides stability, reliability, and affordability.

BRIEF SUMMARY

Embodiments of the invention relate to walking assistance devices. In particular, example embodiments of the invention increase the comfort of walking assistance devices relative to conventional walking assistance devices. Moreover, the present invention provides for a walking assistance device that is more stable, more reliable, and more economical relative to conventional walking assistance devices.

In one example embodiment, a walking assistance device includes a support member that has a first end and a second end. Attached to the first end is a hand grip, and attached to the second end is a base member. The base member includes a rounded surface that is configured to rotatably pivot relative to a walking surface. The base member may further include a foot portion that has a toe and a heel. The toe and the heel may be the same length, or alternatively they may have varying lengths. Additionally, a friction pad is optionally attached to the foot portion and may be configured with tread to engage the walking surface in a way that provides traction to the walking assistance device.

In another example embodiment, a walking assistance device includes a support structure that has a first end and a second end. Attached to the first end is, for example, an underarm support. A hand grip may be attached to the support structure at a location on the support structure that is between the first end and the second end. A base member is coupled to the second end of the support member and is configured to rotate relative to a walking surface. A friction pad may be attached to the base member. The friction pad may be made from rubber and include a tread pattern that is configured to engage the walking surface in a way that provides traction between the walking assistance device and the walking surface.

In an additional example embodiment, a base member for a walking assistance device is disclosed. The base member includes a foot portion having a toe and a heel. A bottom surface of the foot portion joins the toe and the heel. The bottom surface has a radius that permits the base member to rotatably pivot on, or relative to, a walking surface. The toe and the heel may have the same dimensions, or alternatively, the toe and heel may have differing dimensions. A friction pad may also be included on the base member to provide traction between the base member and the walking surface.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. Additional features of the invention will be set forth in the description which follows. The features of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof, which are illustrated in the appended drawings. It will be appreciated that these drawings may illustrate example embodiments in a schematic or diagrammatic nature, and therefore are not necessarily drawn to scale. Understanding that these drawings depict only typical embodiments of the invention, and are not therefore to be considered to be limiting of its scope, the invention will be described and explained with additional specificity and detail through the use of the accompanying drawings in which.

DETAILED DESCRIPTION OF SOME EXAMPLE EMBODIMENTS

In the following description, numerous specific details are set forth in order to provide a thorough understanding of the present invention. It will be obvious, however, to one skilled in the art that the present invention may be practiced without these specific details. Furthermore, various features are described in accordance with one embodiment, may alternatively, or additionally be applied to other embodiments. In other instances, well-known aspects of walking assistance devices have not been described in particular detail in order to avoid unnecessarily obscuring the present invention.

It should also be understood that the drawings are diagrammatic and schematic representations of such exemplary embodiments. Thus, while the figures illustrate embodiments of the invention according to one scale, it will be appreciated that they are not limiting of the present invention, and are not necessarily drawn to scale for all embodiments of the invention. In particular, unless specifically claimed, no particular size, shape or other configuration is required.

1. Example Walking Assistance Devices

Figure 1A:
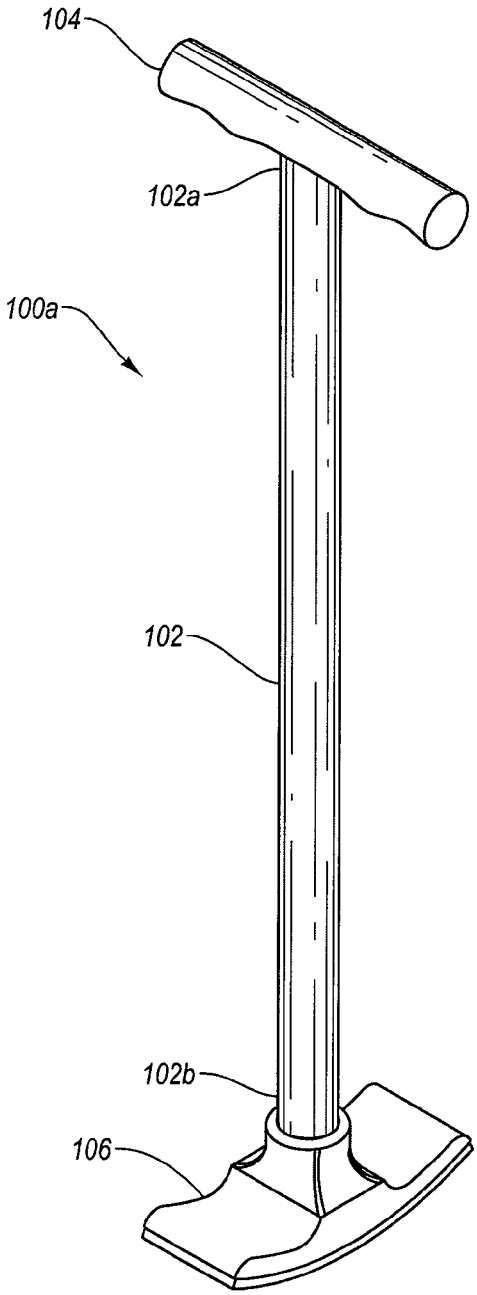
FIG. 1A illustrates a perspective view of an example walking assistance device.
Figure 1B:
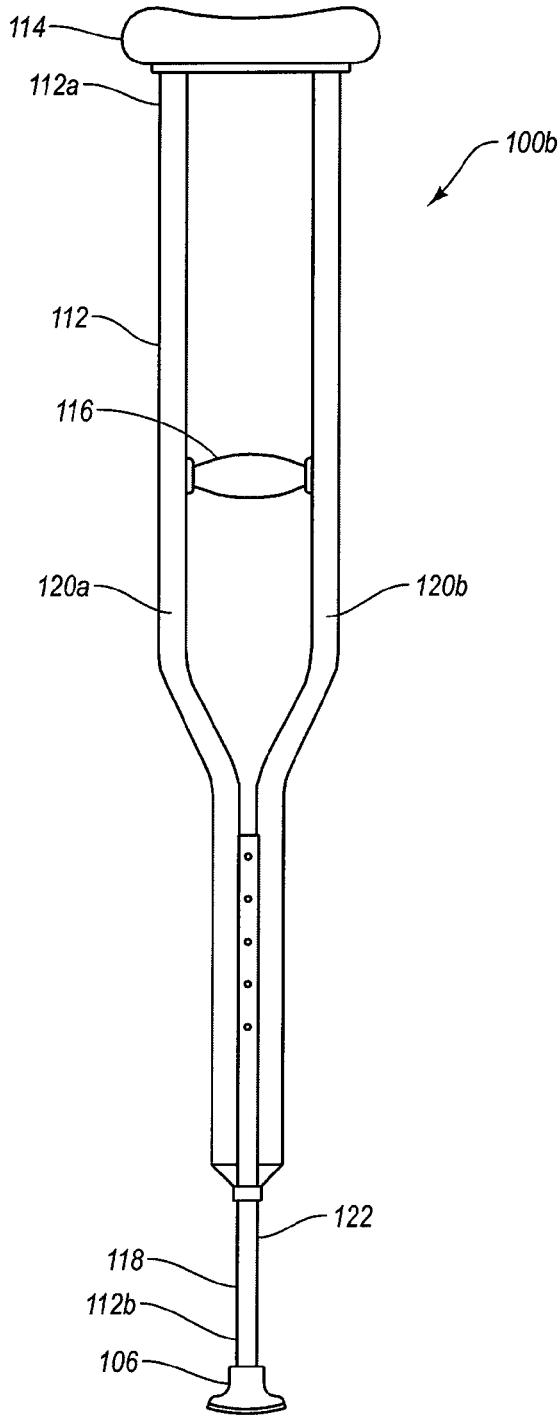
FIG. 1B illustrates a perspective view an example walking assistance device, and which may include an underarm support.

The present invention may be practiced with a wide variety of walking assistance devices, and non-limiting examples of walking assistance devices suitable for application with the present invention include, but are not limited to, canes, crutches, walkers, hiking staffs, walking sticks, sport sticks, rehab devices, and artificial limbs. Two such illustrative examples are shown in FIGS. 1A and 1B, which show two example embodiments of walking assistance devices 100*a* and 100*b*, respectively. In particular, FIG. 1A illustrates an example walking assistance device 100*a* that has a walking stick or cane configuration. According to one embodiment of the present invention, walking assistance device 100*a* includes a support member 102 that has a first end 102*a* and a second end 102*b*. A hand grip 104 may be coupled to, or otherwise disposed on, first end 102*a* of support member 102. A base member 106 is optionally coupled to or otherwise disposed on second end 102*b* of support member 102.

As is further shown in FIG. 1A, walking assistance device 100*a* can be configured to provide support, stability and/or balance to a user in motion (e.g., walking) or even while standing. Support member 102 can have or include a substantially rigid member that can support all or a portion of the body weight of a user, while hand grip 104 may provide a stable grip to the user while walking assistance device 100*a* is in use. Base member 106 may further provide a stable, reliable, and secure contact surface that reduces the risk of base member 106 slipping relative to a walking surface. In at least one embodiment, this is possible because base member 106 is configured to rotatably pivot on or relative to the walking surface. Moreover, when a user walks with walking assistance device 100*a*, base member 106 may be configured to provide a user with a fluid range of motion, e.g., the motion of the user's arm and body are more fluid and comfortable relative to other walking assistance devices because base member 106 can rotatably pivot on or relative to the walking surface.

With continued reference to FIG. 1A, walking assistance device 100*a* may have various forms and configurations. For example, support member 102 may have a variety of geometric configurations. As illustrated in FIG. 1A, for instance, support member 102 may have a substantially cylindrical configuration with a substantially circular cross-section. However, other example geometric configurations of support members can include those with a rectangle, oval, or diamond cross-sectional configuration, or any other shape or combination of shapes as a cross-sectional configuration. In addition, support member 102 may have a natural stick configuration that includes natural bends, curves, knots, and other natural features, or may also include multiple support members that act cooperatively or independently.

Moreover, support member 102 as illustrated in FIG. 1A has a substantially constant cross-sectional area between first end 102*a* and second end 102*b*. In other example embodiments, however, the cross-sectional area of support member 102 may vary between its ends. For example, the cross-sectional area of support member 102 may gradually decrease from first end 102*a* toward second end 102*b* in a substantially constant, or stepwise manner. Alternatively, the cross-sectional area may decrease from first end 102*a* toward a middle of support member 102 and then remain constant or even increase towards second end 102*b*. The cross-sectional area may of course increase from first end 102*a* toward second end 102*b*, and/or may chance shape along a length of support member 102.

In addition to the cross-sectional configuration, the length of support member 102 (i.e., the distance between first end 102*a* and second end 102*b*) is another geometric configuration that may vary. The length of support member 102 may be almost any length that accommodates a comfortable walking assistance device 100*a*. The length may depend on the type of walking assistance device (e.g., cane, walking stick, or forearm crutch) and/or upon the height and/or arm length of the user. For example, a cane may have a height that is approximately one half the height of a user, whereas a walking stick may have a height of approximately the total height of the user. In some cases, a cane or walking stick has a height that is between thirty-six and sixty inches, although they may also be taller or shorter based on the circumstances.

Moreover, support member 102 may optionally be configured to have an adjustable length. For example, instead of being a single piece of material, as illustrated in FIG. 1A, a suitable support member may be made from two pieces of material that are subsequently mechanically or otherwise connected to form the support member. One piece of material can have a smaller cross-sectional area than the other piece of material such that the smaller piece of material may slide within the larger piece of material allowing the length of the support member 102 to adjust in a telescoping manner. In the adjustable length embodiment that has two pieces, one or both of the two pieces of the support member may have latches or locking mechanisms that lock the two pieces of support member together to produce varying overall lengths of the support member 102. Of course, more than two pieces may also be combined in the formation of the support member.

Where multiple pieces are used to form a support member, such pieces may be made from the same type of material or from different materials. Generally speaking, a support member such as support member 102 may be made from any of a variety of materials. Example support member 102 materials that may be suitable include metals and metal alloys (e.g., steel, aluminum alloys, or titanium alloys), organic materials (e.g., wood), composites (e.g., glass or carbon fiber), various plastics (e.g., thermoplastic materials or thermoset materials), and/or any other natural or manmade material, or combination thereof, that would structurally support the body weight of a user. In one example, support member 102 may be formed from a natural stick. Moreover, support member 102 may be configured with shock absorption devices, e.g., springs or the like, in order to absorb at least part of the shock associated with using the walking assistance device 100*a*.

With further reference to FIG. 1A, it can further be seen that hand grip 104 may be coupled or otherwise disposed on first end 102*a* of support member 102. The configuration of hand grip 104 may vary from one embodiment to the next. For example, hand grip 104 may be any of various shapes and sizes configured to fit a wide variety of human hands. As shown in FIG. 1A, for example, hand grip 104 may have a generally cylindrical cross-section, having a diameter of about one inch to about two inches. Hand grip 104 optionally includes indentations or variations on the surface of hand grip 104 that correspond generally to human fingers and provide a comfortable grip for a human hand. Furthermore, although hand grip 104 as shown in FIG. 1A is substantially a straight cylinder, in other embodiments the hand grip may bend or curve, for example, thus creating a crook shaped type hand grip.

The shape and size of hand grip 104 may determine how the hand grip 104 is coupled to or otherwise disposed on support member 102. In one example embodiment, shown in FIG. 1A, hand grip 104 is a separate piece of material that is coupled to the support member 102 by way of an attaching means (e.g, mechanical attaching means such as screws, latches, clamps, interference or press fit connections, etc. and/or adhesive attaching means) or any other similar or suitable attachment means that would allow hand grip 104 to securely attach to support member 102. In other embodiments, hand grip 104 and support member 102 may have a uni-body construction, or in other words, hand grip 104 can be integrally formed from the same piece of material as support member 102. The material of hand grip 104 may also vary from one embodiment to the next and may include materials such as plastics, rubber, metals, composites, organic materials, or any combination thereof.

Turning now to FIG. 1B, another example configuration of a walking assistance device 100*b* is illustrated. In this example embodiment, walking assistance device 100*b* generally represents a crutch-type walking assistance device. Similar to walking assistance device 100*a* of FIG. 1A, crutch type walking assistance device 100*b* includes a support structure 112 that has a first end 112*a* and a second end 112*b*. An underarm support 114 is coupled to or otherwise disposed on first end 112*a* of support structure 112, and a hand grip 116 is coupled to support structure 112 at a position between first end 112*a* and second end 112*b* of support structure 112. A base member 106 is coupled to or otherwise disposed on second end 112*b* of support structure 112 in this example embodiment.

As with FIG. 1A, walking assistance device 100*b* in FIG. 1B is configured to provide support, stability and/or balance to a user in motion (e.g., walking) or while standing. Support structure 112 is, in this embodiment, a substantially rigid structure that can support the body weight of a user. Underarm support 114 may also be configured, along with the hand grip 116, to provide stable support and a stable grip to the user while using walking assistance device 100*b*. Base member 106 can further provide a stable, reliable, and secure contact surface that reduces the risk of base member 106 slipping on a walking surface compared to other potential walking assistance device configurations. This is because base member 106 can have a rounded surface that is configured to rotatably pivot on or relative to the walking surface. Moreover, because of the ability of base member 106 to rotatably pivot on or relative to walking surface, walking assistance device 100*b* can provide a user with a fluid range of motion. For instance, the motion of the user's arms and body can be more fluid and comfortable relative to the range of motion provided by other walking assistance device configurations as the user need not worry about maintaining contact that is flush with the ground or that an angled walking assistance device will have a reduced contact surface.

As with walking device 100*a* shown in FIG. 1A, walking assistance device 100*b* shown in FIG. 1B also can have various configurations. For example, support structure 112 of walking assistance device 100*b* may have several variations. As illustrated in FIG. 1B, for instance, support structure 112 may be made up of two support members 120*a* and 120*b* that are coupled with a pivot member 122. Pivot member 122 is coupled with base member 106 and configured to pivot with respect to the walking surfaced during use of walking assistance device 100*b*. As described above, support members 120*a* and 120*b*, along with pivot member 122, may vary in similar ways as described above with respect to support member 102 (e.g., various geometric configurations and/or various materials may be included in the support structure 112). Moreover, pivot member 122 may be coupled to support members 120*a* and 120*b* such that the overall length of support structure 112, and thus the overall height of the walking assistance device 100*b*, is optionally adjustable. Additionally, pivot member 122 and/or support members 120*a* and 120*b* may include shock absorption devices, such as springs or the like, that help reduce at least a portion of the shock associated with using walking assistance device 100*b*.

Continuing with reference to FIG. 1B, underarm support 114 is shown coupled to or otherwise disposed on first end 112*a* of support structure 112. As shown in FIG. 1B, underarm support 114 can be substantially cylindrical in shape. The exterior diameter of underarm support 114 may be custom designed to fit a user's specific specifications regarding size and/or shape. Underarm support 114 may additionally include an underarm pad that may be removable or replaceable in the event that a user wishes to use an alternative underarm pad in order to adjust the size, shape, density and/or thickness of underarm support 114. Underarm support 114, including an underarm pad included therewith or disposed thereon, may be made from elastomeric materials such as EVA, urethane foam, neoprene foam, PVC, natural rubber, cork or any other suitable material.

As with underarm support 114, hand grip 116 may be coupled to or otherwise attached to support structure 112. As shown in FIG. 1B, hand grip 116 is connected between support members 120*a* and 120*b* and is substantially perpendicular to support members 120*a* and 120*b*. In alternative embodiments, hand grip 116 may be oriented between support members 120*a* and 120*b* at various angles with respect to support members 120*a* and 120*b*.

Furthermore, hand grip 116 as shown in FIG. 1B is located approximately midway between the lengths of support members 120*a* and 120*b*, but in other example embodiments hand grip 116 may be located at almost any position. In still another example, hand grip 116 may be configured to be adjustable in order to permit hand grip 116 to be placed in a variety of positions to accommodate height adjustment and a user's desired orientation of the crutch.

Just as the orientation and position of hand grip 116 may optionally vary, the geometric characteristics of hand grip 116 may also vary. For example, hand grip 116 may have varying outside diameters to accommodate a particular palm size of a user. In particular, the contour of hand grip 116 may be configured to correspond with the curve of the palm and the natural cure of the fingers as they grasp hand grip 116. Moreover, the length of the handgrip should be long enough to distribute the forces of grasping hand grip 116 evenly over the palm of the hand and may be customized to maximize each individual user's comfort.

To further increase user comfort, hand grip 116 may be made from one or more of a variety of comfortable materials. For example, hand grip 116 may be fabricated from materials such as EVA, urethane foam, neoprene foam, PVC, natural rubber, cork or any other suitable natural or manmade material, or combination of materials.

2. Example Base Members

Figure 2A:
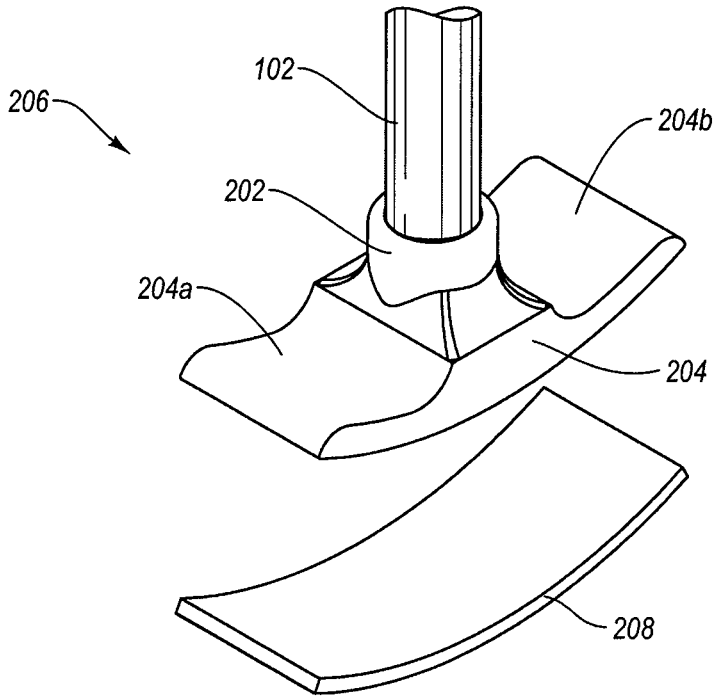
FIG. 2A illustrates an exploded view of an example base member for a walking assistance device.
Figure 2B:
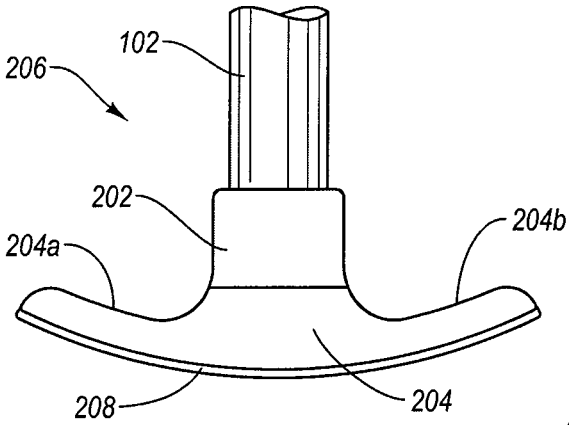
FIG. 2B illustrates a side view of the example base member illustrated in FIG. 2A.
Figure 2C:
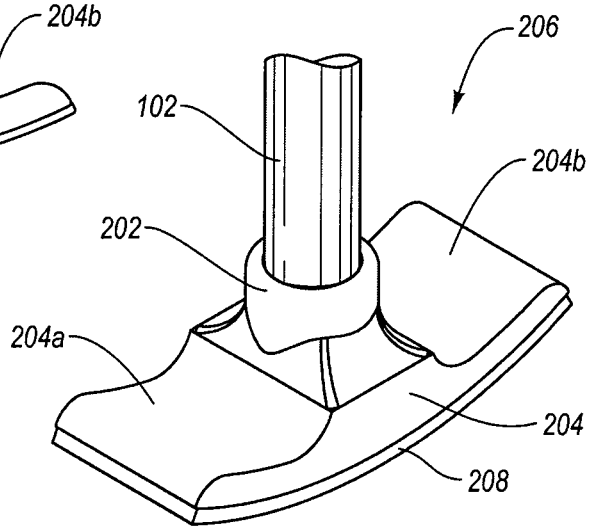
FIG. 2C illustrates a perspective view of the example base member illustrated in FIGS. 2A and 2B.

Both walking assistance devices 100*a* and 100*b* shown in FIGS. 1A and 1B, respectively, include a base member 106. Referring now to FIGS. 2A through 2C, an example of base member 206 is illustrated and described in greater detail. In this example, base member 206 includes an interface region 202. A foot portion 204 is adjacent to and below interface region 202, with foot portion 204 extending to create a toe 204*a* and a heel 204*b*. A pad 208, which may be a friction pad, may also be disposed on the bottom of foot portion 204.

As mentioned above, base member 206 can provide a stable, reliable, and secure contact surface to interface with a walking surface (e.g. a sidewalk or dirt pathway), and which satisfies a long felt need created by conventional walking assistance devices. It may do so inasmuch as base member can rotatably pivot on, or relative to, the walking surface. Moreover, when used with a walking assistance device, such as those discussed with reference to FIGS. 1A and 1B, the base member 206 is configured to provide a user with a fluid range of motion. As a result, the motion of the user's arms and body are more fluid and comfortable relative to the range of motion provided by other walking assistance devices lacking a base member as described and/or claimed herein.

FIGS. 2A through 5B illustrate various example embodiments of base members suitable for use with walking assistance devices. As can be appreciated, each of the example embodiments may be used in connection with walking assistance device 100*a* and/or 100*b*, or any other walking assistance device described herein or as would readily be appreciated by one skilled in the art in view of the disclosure herein. Furthermore, the use of any specific example embodiment of the base member is not limited to a particular walking assistance device type or configuration. For purposes of clarity, however, the base members illustrated in FIGS. 2A through 5B will be discussed as being coupled with a walking assistance device 100*a* as shown in FIG. 1, but, it is to be understood that such base members may be coupled to the walking assistance device 100*b* or any other type or configuration of a walking assistance device.

As stated, FIGS. 2A through 5B illustrate various embodiments of suitable base members, configurations of which may vary from one embodiment to the next. For example, interface region 202, which provides for a connection between base member 206 and support member 102, is one way in which base member may vary. FIGS. 2A through 5B generally show that an interface region may be configured to accept support member 102. Referring to FIG. 2A, the interface region 202 may include, for example, screw threads that correspond to mating screw threads located on support member 102 such that a screw type connection is made between base member 206 and support member 102. Alternatively, interface region 202 may securely couple to support member 102 by way of a toleranced slip fit with or without the use of adhesive. Naturally, other attachment means may also be utilized.

For example, in another example, interface region 202 may include a quick release latching mechanism that allows interface region 202 to release support member 102 by pressing a button or moving a latch to release the latching mechanism. In this way, a user may switch between different base member 206 configurations on-the-fly depending on which base member 206 configuration, for example, will work best on the type of walking surface encountered by the user.

In addition to changing the configuration of base member 206 efficiently, a user may wish to change the orientation of base member 206 depending on the type of walking surface, or perhaps on the type of injury or health problem that requires the use of the walking assistance device. FIGS. 1A and 1B show example orientations of base member 106 relative to hand grips 104 and 116, respectively. In particular, FIG. 1A illustrates an example walking assistance device 100*a* where base member 106 is oriented such that foot portion 204 (as shown in FIG. 2A) is substantially perpendicular relative to hand grip 104. In particular, a length of foot portion 204 as may be measured between toe 204*a* and heel 204*b*, may be generally perpendicular or orthogonal relative to hand grip 104. Alternatively, and as shown in FIG. 1B, base member 106 may be oriented such that foot portion 204 (shown in FIG. 2A) is substantially parallel relative to hand grip 116.

Interface region 202, shown in FIGS. 2A-2C, may be configured to provide the user the ability to adjust the orientation of base member 206 with respect to hand grip 104 (shown in FIG. 1A) or other portion of walking assistance device 100*a* in order to increase comfort during use. For example, base member 206 may include a releasable latch mechanism that permits base member 206 to rotate about support member 102 until base member 206 reaches a desired orientation, at which time the user may secure or lock base member 206 at the desired orientation. For instance, base member 106, in FIG. 1, could be rotated or tilted and then selectively or permanently fixed in place such that that toe 204*a* is relatively closer to hand grip 104 when compared to heel 204*b*. Of course, the opposite is also true, and heel 204*b* could be positioned relatively closer to hand grip 104 than toe 204*b*.

Figure 3A:
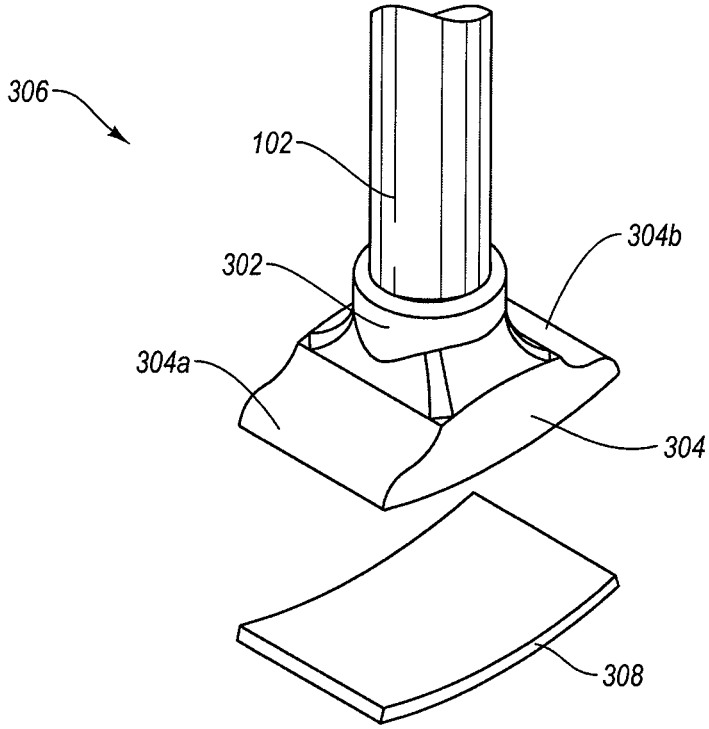
FIG. 3A illustrates an exploded view of an alternative embodiment of an example base member for a walking assistance device.
Figure 3B:
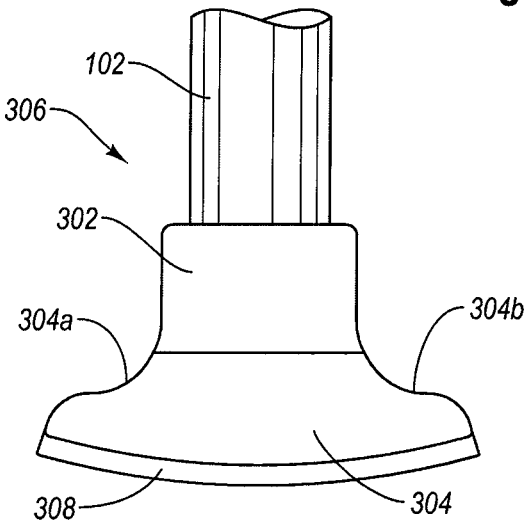
FIG. 3B illustrates a side view of the example base member of FIG. 3A.
Figure 3C:
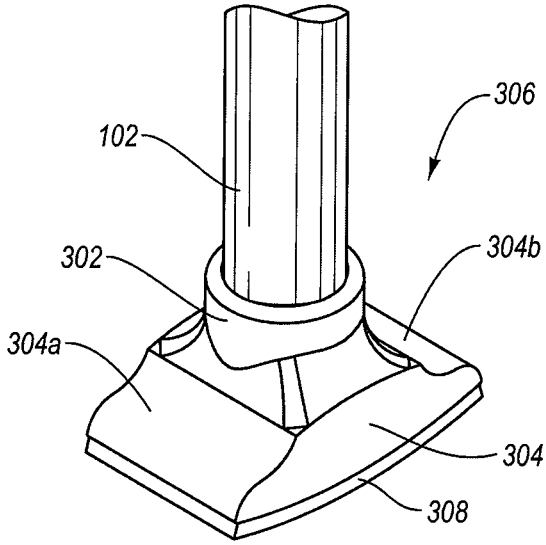
FIG. 3C illustrates a perspective view of the example base member illustrated in FIGS. 3A and 3B.
Figure 4A:
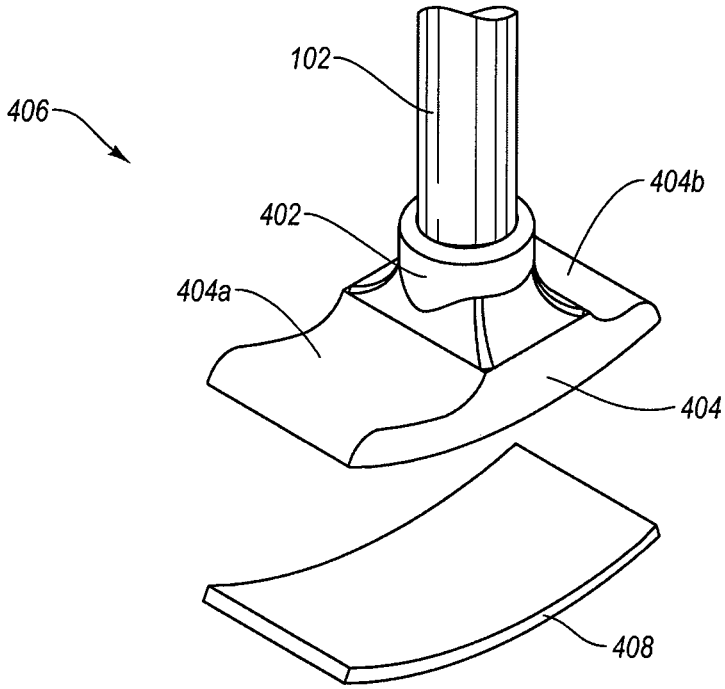
FIG. 4A illustrates an exploded view of another example embodiment of a base member for a walking assistance device.
Figure 4B:
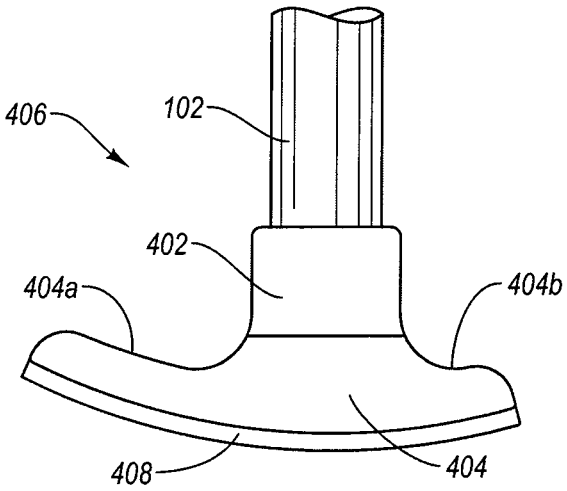
FIG. 4B illustrates a side view of the example base member in FIG. 4A.

Continuing with FIGS. 2A through 2C, interface region 202 can be positioned adjacent to foot portion 204 of base member 206. Foot portion 204 may have various configurations from one embodiment to the next. For example, and as shown in FIGS. 2B, 3B and 4B, foot portion 204, 304, and 404 may have various lengths. For example, in FIG. 2B toe 204*a* and heel 204*b* extend a substantial length. For instance, in one embodiment, the length between toe 204*a* and heel 204*b* may be about six inches. Other embodiments may have longer lengths between toe 204*a* and the 204*b*.

Alternatively, the length between toe 204*a* and heel 204*b* may be marginally or significantly shorter. FIG. 3B illustrates one example embodiment where the length of foot portion 304 between toe 304*a* and heel 304*b* is shorter than that shown in FIG. 2B. By way of example, the length between toe 304*a* and heel 304*b* in FIG. 3B may be as short as about two inches, although other embodiments may have a shorter toe 304*a* to heel 304*b* length.

Figure 4C:
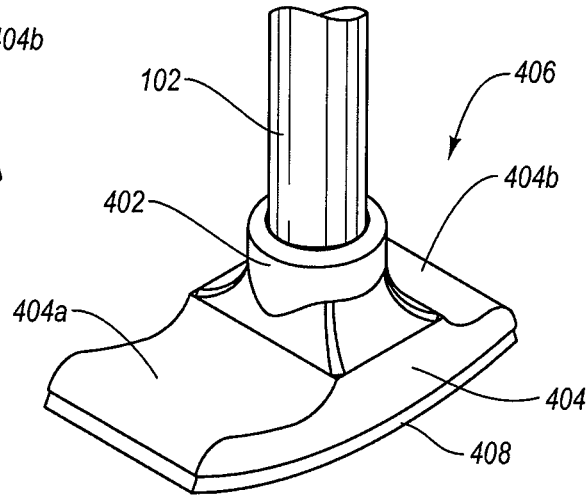
FIG. 4C illustrates a perspective view of the example base member in FIGS. 4A and 4B.

Additionally, while FIG. 2B illustrate a length between toe 204*a* and heel 204*b* that is generally divided evenly between toe 204*a* and heel 204*b*, this need not always be the case. For example, and as illustrated in FIGS. 4A through 4C, a toe 404*a* may have a longer length compared to a shorter heel 404*b*. In another example embodiment, heel 404*b* may be longer than toe 404*a*.

Similar to the length of the foot portion 204, the width of foot portion 204 (i.e., the distance across the toe 204*a* and/or the heel 204*b*) may vary from one embodiment to the next. As illustrated in FIGS. 2A through 4C, for instance, the width of foot portion 204, 304, and 404 may be substantially constant. For example, FIG. 2C illustrates that the width of the foot portion 204 is substantially the same for toe 204*a* and heel 204*b*. In some embodiments, the width of foot portion 204 may range from about one inch to about three inches wide; however, in other embodiments foot portion 204 may be wider or thinner as desired.

In another example embodiment, the width of foot portion 204 may vary along foot portion 204. For example, toe 204*a* may have a larger or smaller width compared to heel 204*b*. Additionally, the width of toe 204*a* and/or heel 204*b* may vary within a single embodiment. For example, the width of the toe may be wider at the portion of toe 204*a* adjacent to interface region 202, and then narrow as it approaches the end of toe 204*a*. The width of toe 204*a* may vary in a constant, stepped, or other manner. Additionally, or alternatively, toe 204*a* may have a plurality of narrow and/or wide regions. As mentioned, the width of heel 204*b* may also vary in a similar manner as described with respect to toe 204*a*.

Just as the width of foot portion 204 may vary, so too may the height of foot portion 204 (i.e., the distance from the bottom surface of foot portion 204 to the top surface of foot portion 204) from one embodiment to the next. For example, the height of foot portion 204 may range from about one half inch to about one inch, although the height of foot portion 204 may be larger or smaller than this in other example embodiments. For instance, foot portion 204 may have a height between one and two inches, although even greater heights are naturally possible and contemplated herein. Moreover, the height of foot portion 204 may vary throughout the same base member 106. For example, FIG. 2B illustrates one example height of foot portion 204 that has a larger height in the middle the of foot portion 204 relative to toe 204*a* and heel 204*b*. Also, the toe 204*a* and heel 204*b* generally have an equal height relative one to another. Alternatively, toe 204*a* may have a different height than that of heel 204*b*.

Related to the relative dimensions of base member 206 are various geometric configurations of the base member 206 that may vary from one embodiment to the next. The geometric configuration as seen from a top view of base member 206 is one way in which the geometric configuration of base member 106 may vary. For example, FIG. 2C (also FIGS. 3C and 4C) illustrate perspective views of base member 206 that, from a top view, would have a generally rectangular configuration. In other embodiments the top view may show an oval, triangle, square, circle or any other configuration, or a combination of configurations.

Another geometric configuration of foot portion 204 that may vary is the bottom surface of foot portion 204. As illustrated in FIGS. 2A through 4C, the bottom surface of a foot portion can have a surface radius. The surface radius of the bottom surface (i.e., the radius of curvature of the bottom surface) of the foot portion 204 may, however, vary from one embodiment to the next, as well as within a single embodiment. In particular, the surface radius may be almost any radius. Examples of surface radii may be within the range of about one inch to about six inches, however, other examples of the surface radii may be larger or smaller. In one example embodiment, the surface radius is about four and one-half inches.

One aspect of a foot portion 204 having a surface radius is that as the user of a walking assistance device moves forward or backward, the natural motion of the user's arm can cause the device to angle forward or backward, while the curved surface maintains contact with the ground surface. For example, a user standing upright may hold the walking assistance device upright. As the user takes a step forward, the user's arm can also move forward, thereby causing the walking assistance device to have move from an upright position to an angled position relative to the ground. As the walking assistance device does so, the curved nature of the bottom surface of foot portion 204 allows foot portion to rotate on and/or relative to the ground surface, and maintain a substantially constant surface area on the ground. In particular, as the user walks, foot portion 204 may rotate such that toe 204*a* moves closer to the ground surface, while heel 204*b* is elevated further from the ground surface. Thus, in contrast to conventional walking assistance devices that have flat surfaces that, when angled, lose contact area, a walking assistance device according to the present invention can rotate as the device moves, thereby maintaining a substantially constant contact area.

By way of example, FIG. 2A illustrates an example embodiment where the bottom surface of the foot portion 204 has a constant radius. Alternatively, and as mentioned above, the bottom surface may have a varying radius. For example, the toe 204*a* may have a different radius than the heel 204*b*. Moreover, the bottom surface of the foot portion may have areas with a radius as well as areas that are flat (i.e., have an infinite, or nearly infinite, radius of curvature). For example, the entire bottom surface of foot portion 204 may have a constant surface radius, except for a distal end of toe 204*a*, which may be flat. In this way, the radius of the bottom surface of foot portion 204 may be customized to the particular needs of a user.

Figure 5A:
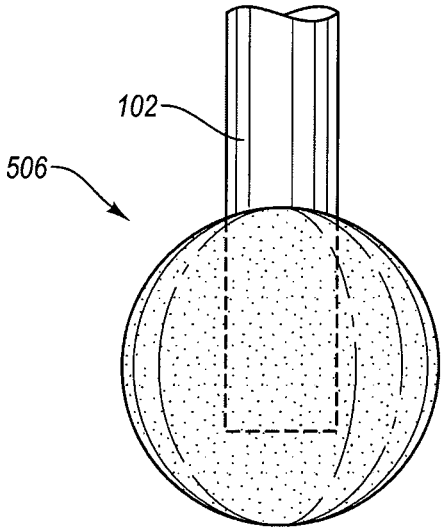
FIG. 5A illustrates a side view of an example base member with a generally spherical configuration, and that may be used for a walking assistance device.
Figure 5B:
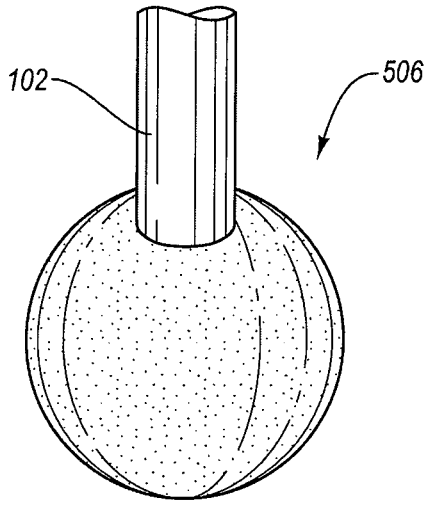
FIG. 5B illustrates a perspective view of the example base member illustrated in FIG. 5A.

Another way in which the surface radius may vary is the extent to which the radius makes up the foot portion 204. For example, FIGS. 2A through 4C illustrate an example embodiment where the radius is substantially on the bottom surface of the foot portion 204, such that the radius may be defined only between toe 204*a* and heel 204*b*. Alternatively, the surface radius may substantially make up the majority of the foot portion. For instance, as illustrated in FIGS. 5A and 5B. The base member 506 illustrated in FIGS. 5A and 5B has, for example, a generally spherical configuration that provides a surface radius on substantially the entire surface. The spherical configuration of the base member 506 may permit the base member 506 to contact a walking surface (e.g. a rocky path) at multiple locations on the base member 506, thus providing stability and support on uneven terrain. Such a configuration may also thus not include toe and/or heels, but instead have a full radius of curvature.

Figure 6A:
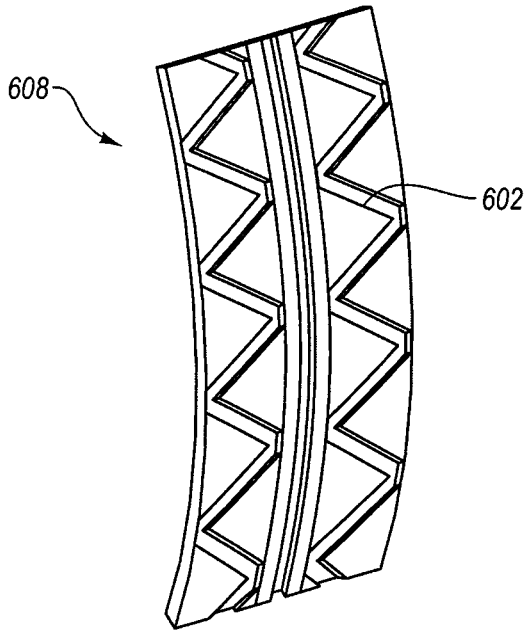
FIG. 6A illustrates a perspective view of an example friction pad.
Figure 6B:
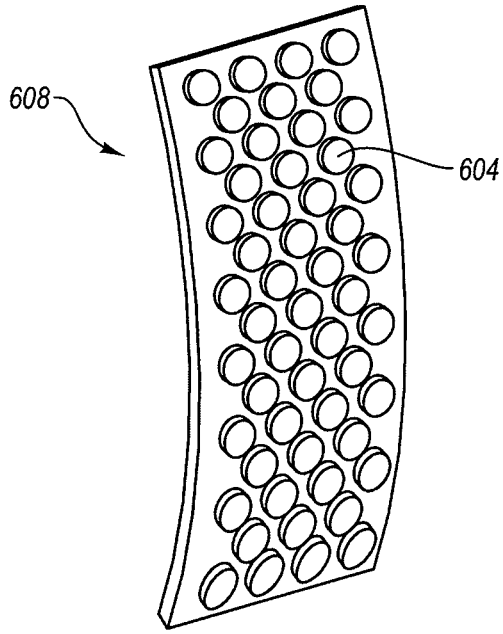
FIG. 6B illustrates a perspective view of another example friction pad.
Figure 6C:
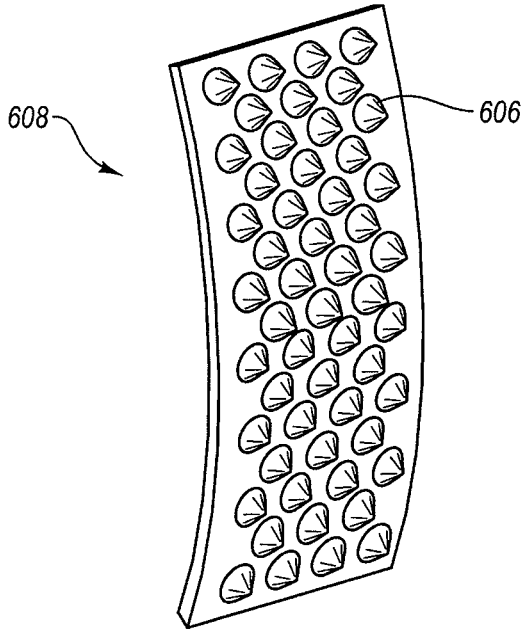
FIG. 6C illustrates a perspective view of still another example friction pad.

In addition to providing multiple locations on a base member to contact a walking surface, FIGS. 6A through 6C illustrate that pad 608 may have various configurations that aid in providing traction and stability on a wide variety of walking surfaces. For instance, one manner in which pad 608 may provide for traction and/or stability is with a tread pattern. In other embodiments pad 608 may have non-slip surface that acts in a manner similar to a tread pattern. FIGS. 6A through 6C illustrates three example embodiments of tread patterns that may be incorporated in pad 608. In particular, FIG. 6A illustrates an example tread pattern that contains a number of triangular channels 602 on both sides of pad 608, and that may be configured to grip relatively hard flat surfaces such as hardwood floors or concrete sidewalks, for example.

FIGS. 6B and 6C illustrate two additional examples of tread patterns that may be incorporated in the pad 608. In FIG. 6B, pad 608 that includes a plurality of protrusions 604. Although the protrusions 604 are illustrated in FIG. 6B as substantially circular, disc-shaped protrusions with a flat surface, other examples protrusions may have various other configurations. For example, FIG. 6C illustrates another example tread pattern that includes a plurality of pointed protrusions 606.

The plurality of protrusions may also have various cross-sectional shapes. For example, instead of a circular cross-section as shown in FIGS. 6B and 6C, the protrusions may be rectangular, triangular, or any other shape. Moreover, several differently configured protrusions may be incorporated on the same pad 608. In the same respect, multiple tread patterns may be incorporated on the same pad 608. For example, the tread patterns in FIGS. 6A, 6B, and 6C could all be combined on one-third portions of a pad.

The tread patterns may be formed in various types of materials that may make up pad 608. In one example embodiment, the pad is made from synthetic rubber. However, in other embodiments the pad may be made from natural rubber, plastic, or any other material with a sufficient enough coefficient of friction that provides a desired non-skid surface.

Notwithstanding the type of material used to create pad 608, other characteristics of pad 608 may vary. For example, the thickness of friction pad 608 may be almost any thickness as desired by the user. An example thickness would be about one-eighth inch thick, but may be more (e.g, one-quarter inch thick or more) or less (e.g., one-sixteenth inch, or less) depending on the desired feel and or the tread pattern, for example.

The thickness of a pad may determine how a friction pad is attached or otherwise combined with a foot portion of a base member. FIGS. 2A, 3A, and 4A show an exploded view of example base members 206, 306, 406 that illustrate how pads 208, 308, 408 is configured to attach to the respective foot portions of base members 206, 306, 406. In one example embodiment, shown in FIG. 2A, the pad 208 glued to foot portion 204. Alternate methods, however, may be used such as a boot type connection (e.g. pad 208 fits around foot portion 204 like a boot, such that it is also positioned around one or more side surfaces of foot portion 204), a mechanical fastener (e.g., a screw, clamp, bracket, or latch), vulcanizing, heat shrinking, chemical melt, a laser melt, or even a one piece construction may be used where the entire base member 206 is made from the pad 208 material. In one embodiment, a pad can be configured to be replaceable upon receiving substantial wear from use. For instance, pad 208 may be selectively removable so that a replacement may be selectively attached.

Just as the pad 208 material may vary, so too may the material of foot portion 204 and/or interface region 202 of base member 206. Examples of materials used for foot portion 204 and/or interface region 202 include, but are not limited to, metals and metal alloys (e.g., aluminum, titanium or titanium alloys), organic materials, rubber (natural or synthetic), polymers, composites, and/or any other natural or manmade material that has the structural properties to support a user in a desired manner. Some example embodiments may use a light weight metal, such as carbon fiber, aluminum or titanium in order to decrease the weight of the walking assistance device.

While light weight materials may be used to decrease the weight of example walking assistance devices, other embodiments may add material or a type of material to weight base member 206 as desired. For example, more weight may be added to toe 204*a* of foot portion 204 in order to give the walking assistance device a particular balance and feel as desired by a user.

Figure 7A:
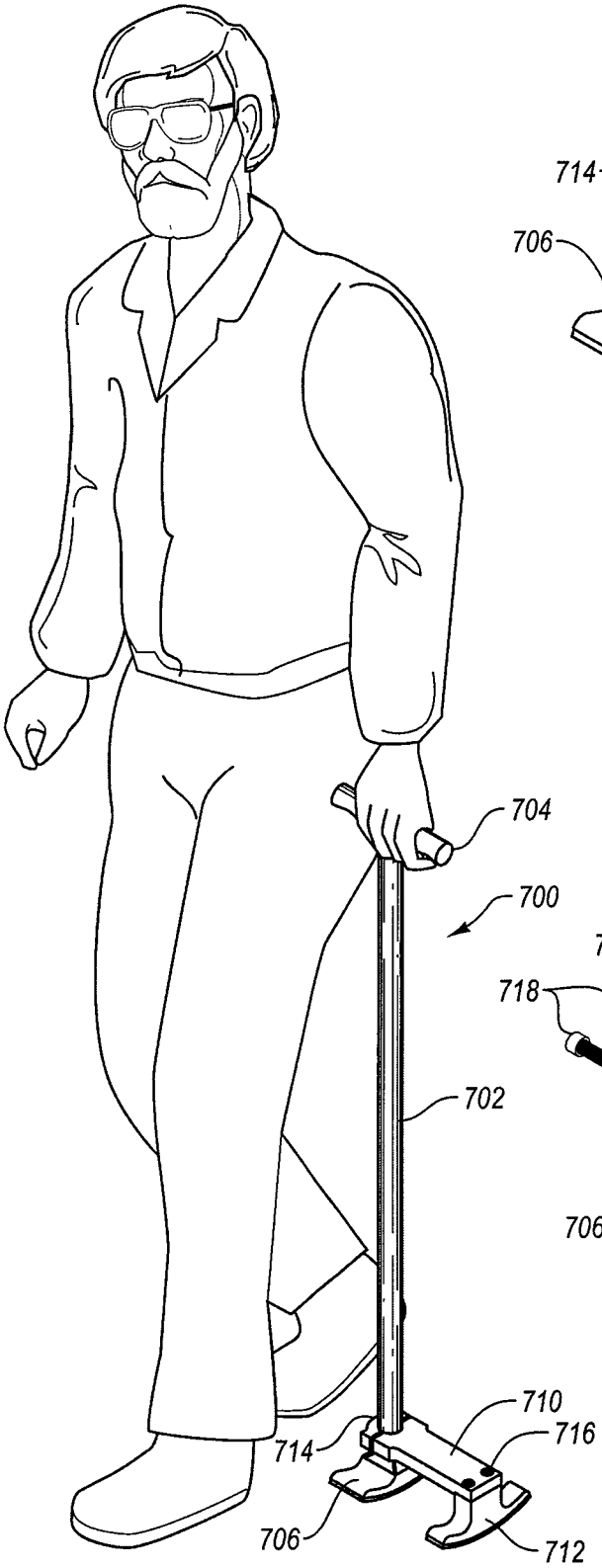
FIG. 7A illustrates a perspective view an example embodiment of a walking assistance device with multiple base members.
Figure 7B:
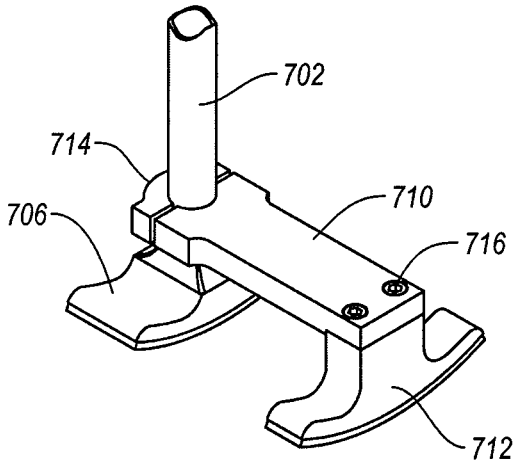
FIG. 7B illustrates a close-up perspective view of the walking assistance device with multiple base members shown in FIG. 7A.
Figure 7C:
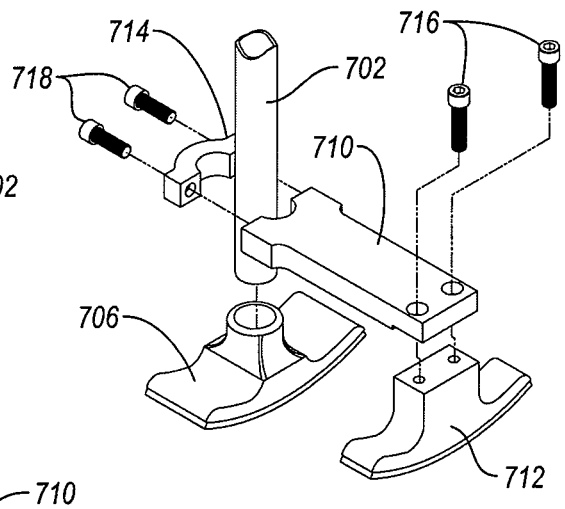
FIG. 7C illustrates an exploded view of the walking assistance device with multiple base members as shown in FIGS. 7A and 7B.

FIGS. 7A through 7C illustrate an additional configuration of a base member 706 that may be utilized in accordance with aspects of the invention as described herein. Such an embodiment may be used for additional weight at the base of a walking device, or to provide a greater area over which the user can be supported.

In particular, at times, a user may require or desire a walking assistance device that has more than one base member in order to provide additional horizontal support and balance. FIG. 7A illustrates an example of a multiple base member walking assistance device 700. Similar to the walking assistance devices previously discussed, in this example the walking assistance device 700 includes a support member 702, a hand grip 704 and a base member 706. In addition, however, the walking assistance device 700 includes an additional base member 712. The additional base member 712 is coupled to one end of an extension 710 with fasteners 716. The opposite end of the extension 710 is coupled to the support member 702 with a clamp 714 and clamp fasteners 718.

FIG. 7B shows a close-up view of the walking assistance device 700 base assembly. As illustrated, the base assembly includes the base member 706 and the additional base member 712. Other example embodiments may include more base members. For example, the walking assistance device 700 may include three, four or more base members. In other embodiments, there may be only a single base member, but it may extend laterally to have a width similar to the width of the two base members illustrated in FIGS. 7A-7C.

The orientation of the additional base member(s) may vary from one embodiment to the next. As illustrated in FIGS. 7A and 7B, the additional base member 712 can be located substantially to one side of base member 706 such that extension 710 extends in a direction approximately ninety degrees from the direction the user is walking. In other examples, extension 710 and additional base member 712 may be oriented in almost any other orientation, such as directly in front of base member 706, or directly behind base member 706.

In one example embodiment, extension 710, and the manner in which additional base member 712 attaches to extension 710, may be configured so as to permit the orientation of additional base member 712 to be easily adjusted. For example, instead of fasteners 716, as illustrated in FIG. 7C, extension 710 may be coupled to support member 702 by way of a quick release latch that would quickly allow extension 710 to be rotated about support member 702 and then locked in a desired position. Furthermore, additional base member 712 may be similarly coupled to extension 710. Various other connectors or connection mechanisms may be used to connect extension 710 to support member 702 and additional base member 712 to extension 710.

In addition to the various connections on extension 710, extension 710 may have various other configurations. For example, the length of extension 710 may vary from one embodiment to the next. Example lengths of extension 710 may be in the range of about three inches to about six inches, but may be longer or shorter depending on a user's needs. In one example embodiment, the length of extension 710 may be adjustable. Similarly, the width of extension 710 may vary. For example, the width may be within the range of about one to about two inches. However, the width may be larger or smaller depending, for example, on the size of the base member 706 and the size of the additional base member 712.

As has been mentioned with other aspects of the walking assistance devices, extension 712, and clamp 714, may be made from a variety of materials. In one example, the material of extension 712 may be aluminum; however, other metals, or polymers, organic materials, composites, and or any other natural or manmade material, or a combination of the foregoing, may be used for the extension as long as the material is structurally able to sufficiently support all or a portion of the weight of a user.

As will be appreciated, various aspects of walking assistance devices are described herein. To avoid unnecessarily complicating the invention, various aspects have been described in terms of one or more embodiments. It should be appreciated, however, that such aspects and features may also be implemented with other embodiments. By way of example, while FIG. 7A illustrates a cane-type walking assistance device 700 having multiple foot portions, it will be appreciated that a crutch type walking assistance device, or any other suitable walking assistance device may also employ a similar design.

Thus, the present invention may be embodied in other specific forms without departing from its spirit or essential characteristics. The described embodiments are to be considered, in all respects, illustrative only and not restrictive. The scope of the invention is, therefore, indicated by the appended claims rather than by the foregoing description. All changes which come within the meaning and range of equivalency of the claims are to be embraced within their scope.

What is claimed is:

1. A walking assistance device, comprising:

a support member having a first end and a second end;

a hand grip coupled to said support member at a location away from said second end; and a first base member coupled to said second end of said support member, said first base member being vertically aligned at least partially with said second end of said support member, wherein said first base member comprises a curved bottom surface having a constant radius of curvature;

a second base member comprising a curved bottom surface having a constant radius of curvature, said second base member being laterally outwardly offset relative to said first base member, said second end of said support member, and a user of the walking assistance device; and an extension having opposing first and second ends, said first end of said extension being coupled to said support member adjacent said first base member and said second end of said extension being coupled to said second base member, wherein said extension extends laterally outwardly from said first base member to said second base member;

wherein said first base member is coupled to at least one of said extension or said second end of said support member; and said first and second base members and said extension cooperate such that the walking assistance device provides both vertical support and horizontal support to a user via the support member and hand grip.

2. The walking assistance device recited in claim 1, wherein said first base member further comprises a first foot portion that includes a first toe and a first heel, said first toe and said first heel joined by said curved bottom surface of said first base member, and wherein said second base member further comprises a second foot portion that includes a second toe and a second heel, said second toe and said second heel joined by said curved bottom surface of said second base member.

3. The walking assistance device recited in claim 2, wherein said first toe and said first heel are different lengths, and said second toe and said second heel are different lengths.

4. The walking assistance device recited in claim 2, wherein a distance between said toe and said heel is a length in the range of about two inches and about six inches.

5. The walking assistance device recited in claim 1, wherein said hand grip is coupled to said support member at said first end of said support member.

6. The walking assistance device recited in claim 1, wherein the constant radii of curvature of said curved bottom surfaces of said first and second base members are within a range of about one inch to about six inches.

7. The walking assistance device recited in claim 1, further comprising: a first pad on said curved surface of said first base member and a second pad on said curved surface of said second base member, wherein said pads are configured to provide traction between said first and second base members and a walking surface.

8. The walking assistance device recited in claim 7, wherein said pads are made from rubber and includes a tread pattern that is configured to engage and provide traction on said walking surface.

9. The walking assistance device recited in claim 1, wherein said first base member has a release mechanism that is operatively associated with said support member and allows a user to selectively disconnect said first base member from said support member and replace it in an efficient manner.

10. The walking assistance device recited in claim 1, wherein said first base member is centered relative to a longitudinal axis of said support member.

11. A walking assistance device, comprising:

a support structure that has a first end and a second end;

an underarm support that is coupled to said support structure proximate said first end of said support structure;

a hand grip coupled to said support structure between said first end and said second end; and a base assembly coupled to said second end of said support structure, said base assembly being configured to rotate relative to a walking surface, and said base assembly comprising:

at least first and second base members, said second base member being laterally outwardly offset relative to said first base member, said second end of the support member, and a user of the walking assistance device, wherein said first base member is at least partially vertically aligned with said second end of said support structure; and an extension member having a first end coupled to said support structure adjacent said first base member and a second end coupled to said second base member, wherein said extension member extends laterally outwardly from said first base member to said second base member;

wherein each of the first and second base members comprises a curved bottom surface having a constant radius of curvature.

12. The walking assistance device recited in claim 11, wherein the radius of curvature is within a range of one inch to six inches.

13. The walking assistance device recited in claim 11, further comprising: a pad secured to at least one of said two or more base members, wherein said pad is configured not to slip on said walking surface and to permit said base assembly to rotatably pivot relative to said walking surface.

14. The walking assistance device recited in claim 11, wherein at least one of said two or more base members has a toe and a heel, and wherein a distance between said toe and said heel is a length of said at least one of said two or more base members and is in a range of two inches to six inches.

15. A base assembly for a walking assistance device, comprising:

a first foot portion, said first foot portion including:

a toe;

a heel; and a bottom surface joining said toe and said heel, wherein said bottom surface is curved with a radius of curvature that permits said base member to rotatably pivot relative to a walking surface while maintaining substantially constant contact with said walking surface, at least over a range of such pivot, wherein said first foot portion is coupleable in vertical alignment with a lower end of a walking assistance device;

a second foot portion, said second foot portion including a curved bottom surface;

an extension having a first end configured to be coupled to the walking assistance device adjacent the lower end of the walking assistance device and a second end coupled to said second foot portion to position said second foot portion laterally outwardly away from said first foot portion, said extension extending between said first foot portion and said second foot portion; and a connection mechanism at said first end of said extension, said connection mechanism being configured to couple said extension to the walking assistance device adjacent the lower end of the walking assistance device, wherein the connection mechanism fixes said second foot portion laterally outwardly away from said first foot portion to prevent movement of the second foot towards the walking assistance device.

16. A base member as recited in claim 15, further comprising a pad coupled to said bottom surface of said first foot portion such that said pad has a radius that permits said base member to rotatably pivot relative to said walking surface.

17. A base member as recited in claim 15, wherein said toe and said heel have the same dimensions and are symmetric, and a length between said toe and said heel is in a range of two to six inches.

18. A base member as recited in claim 15, wherein said toe and said heel have different dimensions, and a length between said toe and said heel is in a range of two to six inches.

19. A base member as recited in claim 15, wherein said radius of curvature is in a range of one to six inches.

* * * * *